US008608519B1

(12) United States Patent
Barna

(10) Patent No.: US 8,608,519 B1
(45) Date of Patent: Dec. 17, 2013

(54) QUICK LOCK CONDUCTOR RECEIVER

(75) Inventor: Kyle Steven Barna, Syracuse, NY (US)

(73) Assignee: Cooper Technologies Company, Houston, TX (US)

( * ) Notice: Subject to any disclaimer, the term of this patent is extended or adjusted under 35 U.S.C. 154(b) by 75 days.

(21) Appl. No.: 13/479,474

(22) Filed: May 24, 2012

(51) Int. Cl.
*H01R 4/50* (2006.01)

(52) U.S. Cl.
USPC ..... 439/864

(58) Field of Classification Search
USPC ..... 439/864, 863, 400, 620.34, 620.28, 439/725, 727, 728, 590
See application file for complete search history.

(56) References Cited

U.S. PATENT DOCUMENTS

| | | | | | |
|---|---|---|---|---|---|
| 1,158,535 | A | * | 11/1915 | Murray | 337/196 |
| 1,350,444 | A | * | 8/1920 | Eustice | 439/864 |
| 1,393,102 | A | * | 10/1921 | Eustice | 337/253 |
| 1,658,522 | A | * | 2/1928 | Frogue et al. | 439/750 |
| 1,917,862 | A | * | 7/1933 | Wadsworth | 439/832 |
| 1,946,897 | A | * | 2/1934 | Carlson | 439/864 |
| 2,011,391 | A | * | 8/1935 | Bennett | 337/196 |
| 2,011,543 | A | | 8/1935 | Meyer | |
| 2,055,438 | A | * | 9/1936 | Gura | 439/725 |
| 2,159,153 | A | * | 5/1939 | Hixon | 439/864 |
| 2,239,660 | A | | 4/1941 | Shipley et al. | |
| 2,305,041 | A | | 12/1942 | Stieglitz | |
| 2,419,007 | A | | 4/1947 | Christensen | |
| 2,866,173 | A | * | 12/1958 | Newcombe | 439/728 |
| 2,907,849 | A | * | 10/1959 | Kobryner | 337/196 |
| 3,054,025 | A | | 9/1962 | Edmunds | |
| 3,132,202 | A | * | 5/1964 | Wolf | 174/87 |
| 3,202,788 | A | * | 8/1965 | George | 337/194 |
| 3,251,927 | A | * | 5/1966 | Iovenko | 174/117 FF |
| 3,418,615 | A | * | 12/1968 | Canney | 337/190 |
| 3,699,500 | A | * | 10/1972 | Borzoni et al. | 439/357 |
| 3,927,929 | A | | 12/1975 | Puetz | |
| 4,157,208 | A | * | 6/1979 | Roberts et al. | 439/204 |
| 4,390,226 | A | * | 6/1983 | Hohn | 439/261 |
| 4,547,036 | A | | 10/1985 | Keglewitsch et al. | |
| 4,613,195 | A | * | 9/1986 | Suher et al. | 439/166 |
| 4,648,674 | A | * | 3/1987 | Sanchez, Jr. | 439/395 |
| 4,775,338 | A | | 10/1988 | Norden | |
| 4,830,631 | A | * | 5/1989 | Hsueh | 439/620.33 |
| 4,845,449 | A | * | 7/1989 | Stern et al. | 333/258 |
| 4,921,450 | A | * | 5/1990 | Herbert | 439/620.26 |
| 4,966,561 | A | | 10/1990 | Norden | |
| 4,986,625 | A | * | 1/1991 | Yamada et al. | 385/55 |

(Continued)

FOREIGN PATENT DOCUMENTS

| | | |
|---|---|---|
| FR | 2919424 | 1/2009 |
| RU | 2346420 | 2/2009 |
| WO | 2008055557 | 5/2008 |

*Primary Examiner* — Amy Cohen Johnson
*Assistant Examiner* — Vladimir Imas
(74) *Attorney, Agent, or Firm* — King & Spalding LLP

(57) ABSTRACT

A conductor receiver is described herein for engaging a conductor. The conductor receiver can include a stationary portion for receiving and securing a bottom portion of the conductor. The conductor receiver can also include a movable portion that is coupled to the stationary portion and has an open position and a closed position. When the movable portion is in the closed position, the movable portion secures a top portion of the conductor. The conductor receiver can also have a channel with a number of rows positioned width-wise within the channel. Each row has at least one member made of conductive material, where each member has a normal position and a retracted position. When the conductor is positioned within the channel, each member is in the retracted position.

16 Claims, 6 Drawing Sheets

(56) References Cited

U.S. PATENT DOCUMENTS

| | | | | | |
|---|---|---|---|---|---|
| 4,997,394 | A | * | 3/1991 | Katz et al. | 439/620.33 |
| 5,018,991 | A | * | 5/1991 | Katz et al. | 439/620.28 |
| 5,072,334 | A | | 12/1991 | Burgess et al. | |
| 5,167,541 | A | * | 12/1992 | Alves et al. | 439/620.29 |
| 5,328,392 | A | * | 7/1994 | Lin et al. | 439/833 |
| 5,444,428 | A | * | 8/1995 | Carr et al. | 337/188 |
| 5,618,209 | A | * | 4/1997 | Lin et al. | 439/620.26 |
| 5,772,473 | A | * | 6/1998 | Cheng et al. | 439/620.34 |
| 5,820,413 | A | * | 10/1998 | Yamada et al. | 439/620.26 |
| 5,888,098 | A | * | 3/1999 | Cheng et al. | 439/620.28 |
| 6,004,159 | A | * | 12/1999 | Liang | 439/620.27 |
| 6,017,243 | A | * | 1/2000 | Castaldo | 439/462 |
| 6,054,915 | A | * | 4/2000 | Rowton et al. | 337/216 |
| 6,326,878 | B1 | * | 12/2001 | Liang | 337/215 |
| 6,696,969 | B2 | * | 2/2004 | Torrez et al. | 340/638 |
| 6,753,754 | B1 | * | 6/2004 | Black et al. | 337/215 |
| 7,195,520 | B1 | * | 3/2007 | Huang | 439/638 |
| 7,244,148 | B2 | | 7/2007 | Maguire et al. | |
| 7,377,813 | B2 | * | 5/2008 | Pentell et al. | 439/620.26 |
| 7,530,850 | B2 | | 5/2009 | Maguire et al. | |
| 7,575,487 | B2 | | 8/2009 | Yodogawa | |
| 7,932,804 | B2 | * | 4/2011 | Buettner | 337/196 |
| 8,009,010 | B2 | * | 8/2011 | Pentell et al. | 337/205 |
| 8,052,481 | B2 | * | 11/2011 | Azad et al. | 439/676 |
| 8,242,874 | B2 | * | 8/2012 | Pavlovic et al. | 337/187 |
| 8,419,475 | B2 | * | 4/2013 | von zur Muehlen | 439/620.26 |
| 2004/0100786 | A1 | * | 5/2004 | Hong | 361/837 |
| 2011/0212653 | A1 | | 9/2011 | Koellmann | |

* cited by examiner

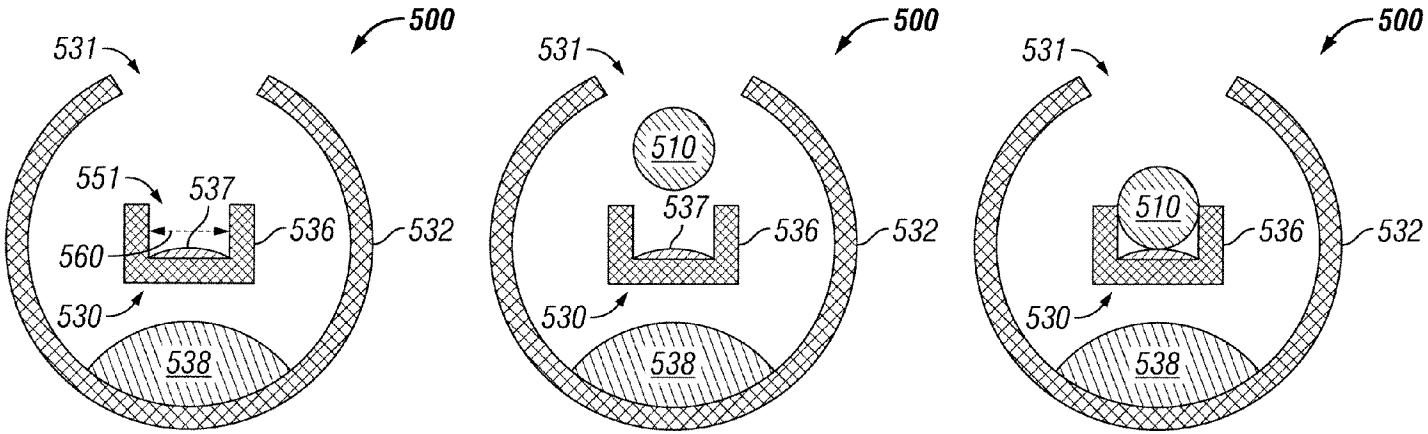
FIG. 5A
FIG. 5B
FIG. 5C
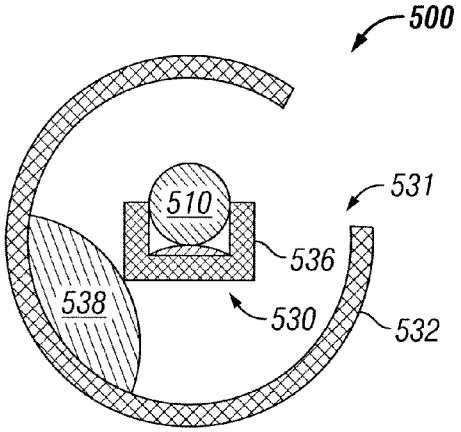
FIG. 5D
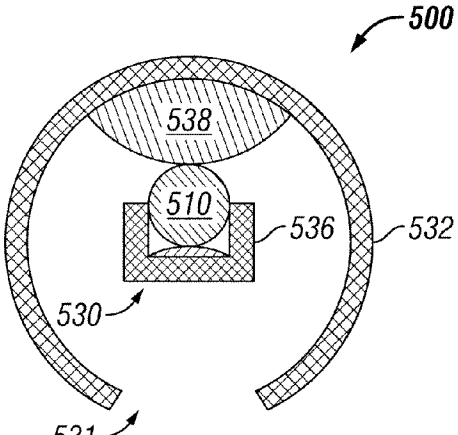
FIG. 5E

QUICK LOCK CONDUCTOR RECEIVER

TECHNICAL FIELD

The present disclosure relates generally to conductor receivers and more particularly to systems, methods, and devices for a quick lock conductor receiver.

BACKGROUND

Conductor receivers use used in a number of different electrical applications. For example, a fuse block uses conductor receivers to allow a fuse to electrically couple in series with the conductors on either end of the fuse block. Other examples where conductor receivers are used include terminal blocks, relay terminals, and motor terminals.

When conductors are not properly connected to a conductor receiver, one or more of a number of electrically-related problems can arise. For example, when voltage is applied to a conductor that is not properly connected to a conductor receiver, overheating (even to the extent of a fire) can result. In addition, mechanically-related problems can arise when conductors are connected to a conductor receiver. For example, strain may stress a conductor when the conductor receiver to which the conductor is connected is not positioned in a manner that allows for strain relief. In addition, tools are required to connect a conductor to a conductor receiver. As a result, properly connecting a conductor to a conductor receiver can be cumbersome and require an amount time.

SUMMARY

In general, in one aspect, the disclosure relates to a conductor receiver. The conductor receiver can include a stationary portion and a movable portion. The stationary portion can include at least one first surface, and at least one first conductive retractable member disposed on the at least one first surface. The stationary portion can also include a channel formed by the at least one first surface and the at least one first conductive retractable member, where the channel has a first width that is less than a second width of a conductor, and where the at least one first conductive retractable member retracts when the conductor engages the channel so that the first width is substantially the same as the second width. The movable portion can have a closed position and an open position and be moveably coupled to the stationary portion, where the movable portion includes at least one second surface, where the at least one second surface secures a top portion of the conductor when the conductor is engaged in the channel and when the movable portion is in the closed position.

In another aspect, the disclosure can generally relate to a conductor receiver. The conductor receiver can include a channel having a number of rows for receiving a conductor having a first width, where the channel includes a second width and an open end along the second width, where the second width is greater than the first width. The conductor receiver can also include a first row positioned within the second width of the channel and having at least one first retractable conductive member that includes a third width that is less than the first width. The conductor receiver can further include a second row positioned within the second width of the channel adjacent to the first row, where the second row has at least one second retractable conductive member having a fourth width, where the fourth width is less than the first width. The at least one first conductive retractable member and the at least one second retractable conductive member can retract when the conductor engages the channel so that the third width and the fourth width are substantially the same as the first width.

In yet another aspect, the disclosure can generally relate to method for engaging a conductor. The method can include receiving a conductor in a stationary portion. The method can also include securing, using at least one first retractable conductive member in the stationary portion, at least a side portion of the conductor, where the at least one first retractable conductive member is in a retracted position when the conductor is positioned within the stationary portion, and where the at least one first retractable conductive member is in a normal position when the conductor is positioned outside the stationary portion.

These and other aspects, objects, features, and embodiments will be apparent from the following description and the appended claims.

BRIEF DESCRIPTION OF THE DRAWINGS

The drawings illustrate only exemplary embodiments and are therefore not to be considered limiting in scope, as the exemplary embodiments may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

FIGS. 5A-5E show various views of a cross-sectional end view of a quick lock conductor receiver in accordance with certain exemplary embodiments.

DETAILED DESCRIPTION

Figure 1A:
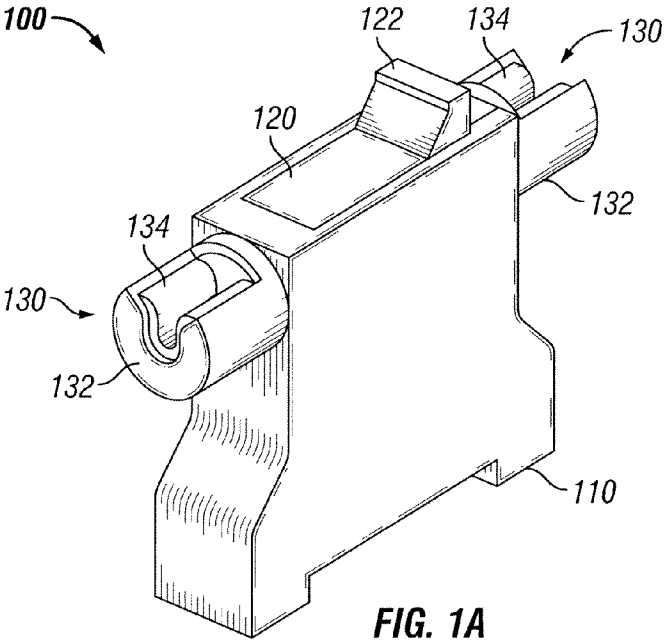
FIGS. 1A-1D show various views of a quick lock conductor receiver in which certain exemplary embodiments may be implemented.

In general, exemplary embodiments provide systems, methods, and devices for quick lock conductor receivers. Specifically, exemplary embodiments provide for securing conductors using conductor receivers that have one or more quick locking mechanisms. The conductor receivers may be used in a stand-alone application (e.g., a single terminal connection point) or in integrated with an electrical device (e.g., a terminal block, a fuse block, a motor, a relay).

While the exemplary embodiments discussed herein are described with reference to a fuse block, one or more of a number of other electrical devices (e.g., motors, relays, terminal blocks, contactors, starters) may be used in conjunction with exemplary embodiments. Use of exemplary embodiments should be performed when the conductor and the connection that is electrically coupled to the conductor receiver are de-energized (i.e., have no current and/or voltage flowing therethrough).

As used herein, the word "retractable" is used collectively for such words and concepts as compressible, under compressive force, under compressive tension, and retractable. Generally, a component that is retractable has a retracted state that results from the component being engaged by a conductor. When the conductor no longer engages the component, then the component returns (e.g., expands, extends) to a normal state. The components can repeatedly change between the retracted state and the normal state.

A user may be any person that interacts with the quick lock conductor receiver. Examples of a user may include, but are not limited to, an engineer, an electrician, an instrumentation and controls technician, a mechanic, an operator, a consultant, a contractor, and a manufacturer's representative.

In certain exemplary embodiments, a quick lock conductor receiver (and/or an electrical device with which a quick lock conductor receiver is integrated) is subject to meeting certain standards and/or requirements. For example, the National Electric Code (NEC) and the Institute of Electrical and Electronics Engineers (IEEE) set standards as to wiring and electrical connections. For example, Underwriters' Laboratories (UL) classifies fuse holders in a number of classes (e.g., Class J, Class T) where each class is defined by a number of categories, including but not limited to fuse characteristics (e.g., time delay, fast acting), interrupting rating (10,000 A, 200, 000 A), and available ampere ratings (e.g., 1-1200, ¼-30). Use of exemplary embodiments described herein meet (and/or allow a corresponding device to meet) such standards when required.

FIGS. 1A-1D depict various views of a quick lock conductor receiver 110 in which certain exemplary embodiments may be implemented. In one or more embodiments, one or more of the components shown in FIGS. 1A-1D may be omitted, repeated, and/or substituted. Accordingly, embodiments of enclosure quick lock conductor receivers should not be considered limited to the specific arrangements of components shown in FIGS. 1A-1D.

Referring now to FIG. 1A, an example of a fuse block 100 that includes a quick lock conductor receiver 130 is shown. The fuse block 100 shown in FIG. 1A is a standard type of fuse block that includes a base 110, a fuse holder 120 with a fuse holder cover 122, and a pair of quick lock conductor receivers 130.

The base 110, the fuse holder 120, and the fuse holder cover 122 may be made of one or more of a number of suitable materials, including metal (e.g., alloy, stainless steel), plastic, some other material, or any combination thereof. The base 110, the fuse holder 120, and/or the fuse holder cover 122 may be made of the same material or different materials. For example, the base 110, the fuse holder 120, and the fuse holder cover 122 may be made of plastic and shaped in any manner suitable for the application for which the fuse block 100 is being used. In addition, the fuse holder 120 may include metal (e.g., copper, aluminum) portions that include fuse clips (configured to hold one or more of a number of suitable fuses based on the application for which the fuse block 100 is being used) and electrically conductive connections within the fuse block 100 between each fuse clip and an adjacent quick lock conductor receiver 130.

The fuse holder cover 122 is secured to the fuse holder 120 using one or more of a number of methods, including but not limited to a fastening device, mating threads, a sliding notch, and a spring release. In one or more embodiments, a fastening device 118 may be one or more of a number of fastening devices, including but not limited to a bolt, a screw, and a clamp. In addition, or in the alternative, one or more hinges may be secured to one side of the fuse holder 120 and a corresponding side of the fuse holder cover 122 so that, when all of the securing methods are removed, the fuse holder cover 122 may swing outward (i.e., an open position) from the fuse holder 120 using the one or more hinges. In one or more exemplary embodiments, there are no hinges, and the fuse holder cover 122 is separated from the fuse holder 120 when all of the securing methods are removed.

In certain embodiments, the quick lock conductor receiver 130 includes a stationary portion 134 that receives at least a bottom portion of a conductor. The stationary portion 134 can include an electrically conductive section 139 and an electrically non-conductive section 138. The electrically non-conductive section 138 of the stationary portion 134 is positioned between the outer surface 137 of the stationary portion 134 and the dividing member 140. The dividing member 140 can be a physical barrier, made of the same or a different material than the material in the electrically conductive section 139 and/or the material in the electrically non-conductive section 138, positioned between the electrically conductive section 139 and the electrically non-conductive section 138. Alternatively, the dividing member 140 can simply be a point inside the stationary portion 134 where the electrically conductive section 139 and the electrically non-conductive section 138 meet.

The outer surface 137 and the dividing member 140 can have one or more of a number of shapes, dimensions, features (e.g., gripping pads), and/or other characteristics. The outer surface 137, the dividing member 140, and the interior of the electrically non-conductive section 138 can be made of one or more of a number of electrically non-conductive materials, including but not limited to plastic, ceramic, rubber, and silicon. The outer surface 137, the dividing member 140, and the interior of the electrically non-conductive section 138 can be made of the same and/or different material.

The electrically conductive section 139 of the stationary portion 134 defines a channel 133 therethrough and is positioned between the inner surface 132 of the stationary portion 134 and the dividing member 140. The inner surface 132 can have one or more of a number of shapes, dimensions, features (e.g., retractable members 136, stationary surface 135), and/or other characteristics. The inner surface 132 can be made of one or more of a number of electrically conductive materials, including but not limited to copper, aluminum, and an alloy.

The size of the electrically conductive section 139 and the size of the electrically non-conductive section 138 can vary. In certain exemplary embodiments, the size of the electrically conductive section 139 is large enough (has enough area and is adequately distributed) to convey the amount of power flowing between the conductor and the associated fuse block 100. In addition, the size of the electrically non-conductive section 138 is large enough (has enough area and is adequately distributed) to allow a user to touch the outer surface 137 of the stationary portion 134 while the conductor is engaged without being subjected to an electrical hazard (e.g., shock, short).

Figure 1B:
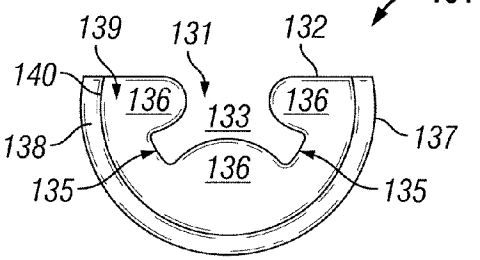

The stationary surface 135 of the electrically conductive section 139 is a surface that does not move substantially toward the dividing member 140 when a conductor is engaged with the stationary portion 134 of the conductor receiver 130. The electrically conductive section 139 allows conductors of various sizes (e.g., 10 American wire gauge (AWG), 12 AWG, 16 AWG) to be secured within the stationary portion 134. The stationary surface 135 of the electrically conductive section 139 is a surface that does not move substantially toward the dividing member 140 when a conductor is engaged with the stationary portion 134 of the electrically conductor receiver 130. By contrast, the retractable members 136 of the electrically conductive section 139 do move (retract) toward the dividing member 140 to assume a retracted position when a conductor is engaged with the stationary portion 134 of the conductor receiver 130. When a conductor is not engaged with the stationary portion 134 of the conductor receiver 130, the retractable members 136 are in a normal position. For example, as shown in FIG. 1B, the retractable members 136 of the stationary portion 134 are in a normal position because there is no conductor being engaged.

In certain exemplary embodiments, the retractable members 136 are made of a compressible material (e.g., memory metal, a malleable metal) and/or are mechanically coupled to one or more compressible features (e.g., a compression spring) that apply an outward force (toward the inner surface 132) on the retractable members 136. As shown in FIG. 1B, the retractable members 136 are, at least, made of a compressible material. An example of retractable members 136 mechanically coupled to a compressible feature is described below with respect to FIGS. 2A through 2C.

In certain exemplary embodiments, the retractable members 136 are positioned in such a way and/or extend away from the dividing member 140 by a certain distance so that the opening 131 through which a conductor is received is smaller than the diameter (size) of the conductor. As a result, the conductor forces one or more of the retractable members 136 to transition from a normal state to a retracted state as the conductor becomes engaged with the stationary portion 134. Because the retractable members 136 are under a compressive force, the retractable members 136 maintain solid contact with the conductor when the conductor is engaged with the stationary portion 134 by being inserted into the channel 133.

The retractable members 136 may have one or more of a number of shapes and/or characteristics. In certain exemplary embodiments, some or all of the retractable members 136 are made of an electrically conductive material. If each conductive, retractable member 136 is continuous along its length, then the conductive material may also be continuous or may exist along one or more segments of the length of the retractable member 136. Because the retractable members 136 are made of a conductive material, electrical connectivity and continuity is ensured between the conductor and the corresponding fuse terminal when the conductor is secured by the retractable members 136 of the stationary portion 134.

In certain exemplary embodiments, the retractable members 136 are located along the sides of the channel 133 of the stationary portion 134 and, in some cases, along the bottom of the channel 133. The channel 133 has an open end (the end furthest away from the fuse block 100) and a closed end (the end that abuts the fuse block 100). The channel 133 formed by the stationary portion 134 has a width (between the sides) and a length (between the open end and the closed end). The channel 133 formed by the retractable members 136 of the stationary portion 134 also has a height. At least the width of the channel 133 can be enlarged when a conductor is engaged with the stationary portion 134. When no conductor is engaged, the width of the channel 133 is smaller than the diameter (size) of the conductor. When the conductor is engaged, the width of the channel 133 is substantially the same to slightly larger than the diameter (size) of the conductor.

In certain exemplary embodiments, the stationary portion 134 faces upward, toward the direction that a user inserts the conductor into the channel 133 of the stationary portion 134. The stationary portion 134 may also face in a different direction with respect to the electrical device and/or the user when inserting the conductor into the channel 133 of the stationary portion 134. In certain exemplary embodiments, the stationary portion 134, when used in conjunction with an electrical device (e.g., the fuse block 100), is fixedly coupled to the electrical device. In other words, once affixed to the electrical device, the stationary portion 134 does not rotate or otherwise change position relative to the electrical device.

In certain exemplary embodiments, the location on the electrical device at which the stationary portion 134 is placed may vary. For example, for a fuse holder 100 used in photovoltaic solar applications, many conductors (e.g., wires) can be fed into a fuse box with a number of fuse holders. In such a case, traditional fuse holders have terminal connectors that are positioned in such a location on the fuse holder (e.g., closer to the bottom end of the fuse holder rather than the top end) as to cause strain on the conductor. As a result, the connection can loosen over time, requiring periodic tightening. In addition, the strain can cause physical wear on the conductor, which can lead to electrical problems (e.g., fault conditions, over-temperature conditions). By placing the stationary portion 134 of the quick lock conductor receiver 130 toward the top of the fuse block 100, as shown in FIG. 1A, exemplary embodiments can provide strain relief on the conductor, which reduces the chance of an electrical problem occurring.

Figure 1C:
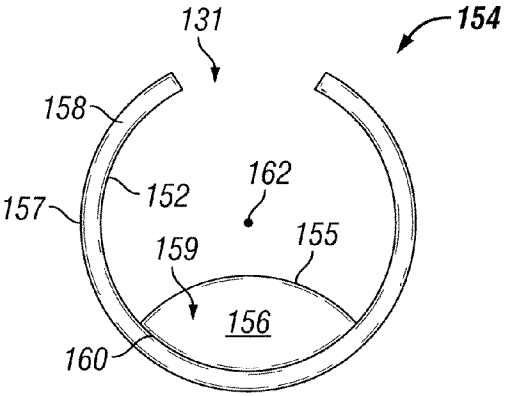

In certain exemplary embodiments, the movable portion 154 of the quick lock conductor receiver 130 secures a top portion of the conductor. As shown in FIG. 1C, the exemplary movable portion 154 includes an opening 131 through which the conductor passes. In certain exemplary embodiments, the opening 131 is the same as the opening described above with respect to FIG. 1B. The movable portion 154 has an open position and a closed position. The open position of the movable portion 154, as shown in FIG. 1C, aligns the opening 131 of the movable portion 154 with the opening 131 of the stationary portion 134 so that a conductor may be received by the stationary portion 134. In such a case, the movable portion 154 rotates axially around the stationary portion 134 to reach the closed position. When the movable portion 154 axially rotates around the stationary portion 134, the amount of rotation required to move between the open position and the closed position of the movable portion 154 is more than 0° and less than 360°. For example, the movable portion 154 may rotate 180° to transition from the open position to the closed position. In the open position, the movable portion 154 does not contact the conductor. In the closed position, the movable portion 154 contacts the top portion of the conductor. Specifically, the retractable member 159 contacts the top portion of the conductor.

Those skilled in the art will appreciate that the movable portion 154 may move between an open position and a closed position in one or more of a number of other ways. For example, the movable portion 154 may be hingedly coupled to an edge of the stationary portion 134, where rotating the movable portion 154 along the hinge moves the movable portion 154 between the closed position and the open position. As another example, the movable portion 154 may be retractable, where the open position is when the movable portion 154 is fully retracted (almost flush with the side of the fuse holder 100 at the closed end of the stationary portion 134), and where the closed position is when the movable portion 154 is fully extended (toward the open end of the stationary portion 134).

In certain exemplary embodiments, the movable portion 154 includes a non-conductive section 158 and, optionally, a conductive section 159. The non-conductive section 158 is made of non-conductive material, and the conductive section 159 is made of conductive material. The non-conductive section 158 of the movable portion 154 is positioned between the outer surface 157 of the movable portion 154 and the dividing member 160 (if the movable portion 154 includes a conductive section 159) and/or an inner surface 152 of the movable portion 154. The dividing member 160 can be a physical barrier, made of the same or a different material than the material in the non-conductive section 158 and/or the material in the conductive section 159, positioned between the conductive section 158 and the non-conductive section 159. Alternatively, the dividing member 160 can simply be a point inside the stationary portion 154 where the conductive section 158 and the non-conductive section 159 meet.

The outer surface 157 and the dividing member 160 can have one or more of a number of shapes, dimensions, features (e.g., gripping pads), and/or other characteristics. The outer surface 157, the dividing member 160, and the interior of the non-conductive section 158 can be made of one or more of a number of non-conductive materials, including but not limited to plastic, ceramic, rubber, and silicon. The outer surface 157, the dividing member 150, and the interior of the non-conductive section 158 can be made of the same and/or different material. In addition, the material of the outer surface 157, the dividing member 150, and the interior of the non-conductive section 158 of the movable portion 154 can be the same or different than the material of the outer surface 137, the dividing member 140, and the interior of the non-conductive section 138 of the stationary portion 134.

The conductive section 159 of the movable portion 154 is positioned between the inner surface 155 of the movable portion 154 and the dividing member 160. The conductive section 159 can have one or more of a number of shapes, dimensions, features (e.g., retractable member, compressible material), and/or other characteristics. The conductive section 159 can be made of one or more of a number of conductive materials, including but not limited to copper, aluminum, and an alloy. The material of the conductive section 159 of the movable portion 154 can be the same or different than the material of the conductive section 139 of the stationary portion 134.

The size of the conductive section 159 and the size of the non-conductive section 158 can vary. In certain exemplary embodiments, the size of the conductive section 159 is large enough (has enough area and is adequately distributed) to convey the amount of power flowing between the conductor and the associated fuse block 100. In addition, the size of the non-conductive section 158 is large enough (has enough area and is adequately distributed) to allow a user to touch the outer surface 157 of the movable portion 154 while the conductor is engaged and the movable portion 154 is in the closed position without being subjected to an electrical hazard (e.g., shock, short). For example, a user may move the movable portion 154 between the open position and the closed position using his bare hands, without the use of special tools/equipment, for ease of handling, and without the risk of electric shock.

The optional retractable member 156 may have one or more of a number of shapes. For example, the retractable member 156 shown in FIG. 1C is a smooth bump, similar in shape to the bump formed by the retractable member 136 along the bottom of the stationary portion 134 in FIG. 1B. The retractable member 156 may have other shapes, including but not limited to dual humps, a concave portion that runs parallel to the curvature of the outer surface 157, and a straight line that runs across a portion of the inner surface 152 of the non-conductive section 158.

In certain exemplary embodiments, the inner surface 155 and/or the conductive section 159 have rigid characteristics that prevent substantial movement toward the dividing member 160 when a conductor is engaged with the stationary portion 134 of the conductor receiver 130 and when the movable portion 154 is in the closed position. Alternatively, the inner surface 155 and/or the conductive section 159 can have flexible characteristics, such as retractable member 156. The retractable member 156 moves (retracts) toward the dividing member 160 to assume a retracted position when a conductor is engaged with the stationary portion 134 of the conductor receiver 130 and when the movable portion 154 is in the closed position. When a conductor is not engaged with the stationary portion 134 of the conductor receiver 130, regardless of the position of the movable portion 154, the retractable member 156 is in a normal position. For example, as shown in FIG. 1C, the retractable member 136 of the movable portion 154 is in a normal position.

In certain exemplary embodiments, the retractable member 156 is made of a compressible material (e.g., memory metal, a malleable metal) and/or is mechanically coupled to one or more compressible features (e.g., a compression spring) that apply an outward force (toward the inner surface 155) on the retractable member 156. As shown in FIG. 1C, the retractable member 156 is, at least, made of a compressible material. In certain exemplary embodiments, the retractable member 156 does not retract, compress, or otherwise appreciably alter its shape when the retractable member 156 contacts a conductor.

In certain exemplary embodiments, the retractable member 156 is positioned in such a way and/or extends away from the dividing member 160 by a certain distance so that the normal distance between the center 160 of the movable portion 154 and the inner surface 155 is smaller than the radius of the conductor. As a result, the conductor forces the retractable member 156 to transition from a normal state to a retracted state as the conductor is engaged with the stationary portion 134 and the movable portion 154 is moved toward the closed position. Because the retractable member 156 is under a compressive force, the retractable member 156 maintains solid contact with the conductor when the conductor is engaged with the stationary portion 134 and the movable portion 154 is moved toward the closed position.

The retractable member 156 may have one or more of a number of shapes and/or characteristics. Further, there may be more than one retractable member 156. In certain exemplary embodiments, some or all of the retractable member 156 is made of an electrically conductive material. Alternatively, some or all of the retractable member 156 is made of an electrically non-conductive material. If the retractable member 156 is continuous along its length, then the conductive material may also be continuous or may exist along one or more segments of the length of the retractable member 156. If the retractable member 156 is made of an electrically conductive material, electrical connectivity and continuity can be improved between the conductor and the corresponding fuse terminal when the conductor is secured by the retractable member 156 of the movable portion 154.

In certain exemplary embodiments, the retractable member 156 is located along all or a portion of the inner surface 152 of the non-conductive member 158. For example, as shown in FIG. 1C, the retractable member 156 is on the opposite side of the movable portion 154 from the opening 131.

In certain exemplary embodiments, the movable portion 154 and/or the stationary portion 134 include one or more features that secure the movable portion 154 in the closed position. For example, a locking mechanism (e.g., a notch in the outer surface 137 of the stationary portion 134 that corresponds to a protruding element on an interior surface 152 of the movable portion 154, where the notch and the protruding element align when the movable portion 154 is in the closed position). As another example, the locking mechanism may be threads on at least a portion of an inside surface 152 of the movable portion 154 and mating threads on at least a corresponding portion of the outer surface 137 of the stationary portion 134. An example of a locking mechanism is shown below with respect to FIGS. 3A-3C.

In addition, the movable portion 154 and/or the stationary portion 134 can include one or more features that prevent the movable portion 154 from being removed, keeping the movable portion 154 and the stationary portion 134 movably coupled. For example, when the movable portion 154 axially rotates around the stationary portion 134 to move between the closed position and the open position, the stationary portion 134 may have a collar protruding from its exterior at the open end, where the collar fits in a slot in the interior of the movable portion 154 to allow the movable portion 154 to rotate axially but not move in the axial direction. Examples of how the stationary portion and the movable portion can be coupled are shown below with respect to FIGS. 3A-4B.

Figure 1D:
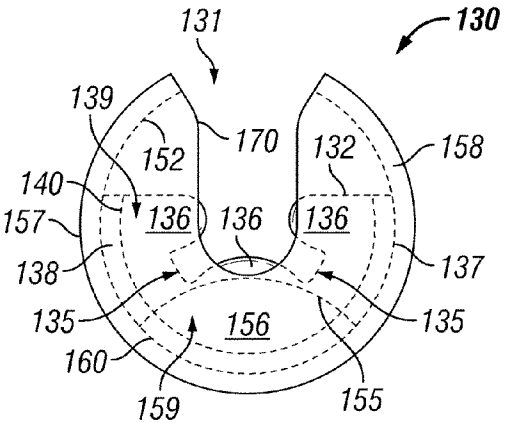

FIG. 1D shows a transparent end view of the quick lock conductor receiver 130 with the stationary portion 134 rotatably coupled to movable portion 154. The movable portion 154 is in the open position so that the opening 131 of the movable portion 154 and the stationary portion 134 are aligned. In this case, the top of the retractable member 156 of the movable portion 154 protrudes past the outer surface 137 of the stationary portion 134 because the retractable member 156 is disposed in a slot in the stationary portion 134 that allows the retractable member 156 to freely move between the closed position and the open position of the movable portion 154. As a result, when the movable portion 154 rotates to the closed position and when a conductor is engaged in the channel 133 of the stationary portion 134, the retractable member 156 contacts and retracts against the top portion of the conductor.

In addition, the end of the movable portion 154 has a larger boundary 170 than a cross-sectional interior of the movable portion 154. The larger boundary 170 on the end of the movable portion 154 may be used for one or more purposes, including but not limited to structural integrity of the movable portion, a mechanism to prevent the movable member 154 from decoupling from the stationary member 134, and a mechanism to allow the movable member 154 to be rotatably coupled to the stationary member 134 in an axial direction.

Figure 2A:
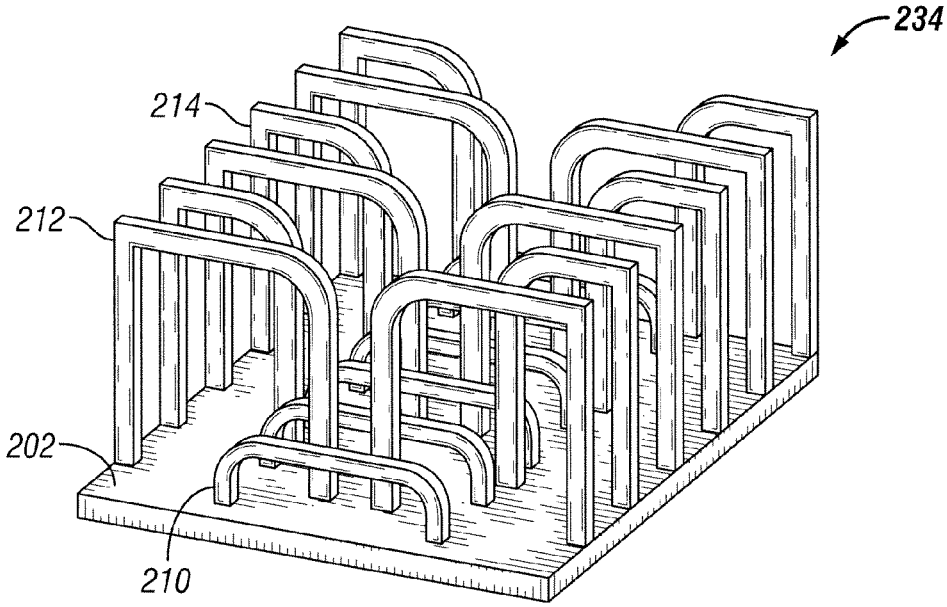
FIGS. 2A-2C show various views of a number of various protrusions of a stationary portion for a quick lock conductor receiver in accordance with certain exemplary embodiments.
Figure 2B:
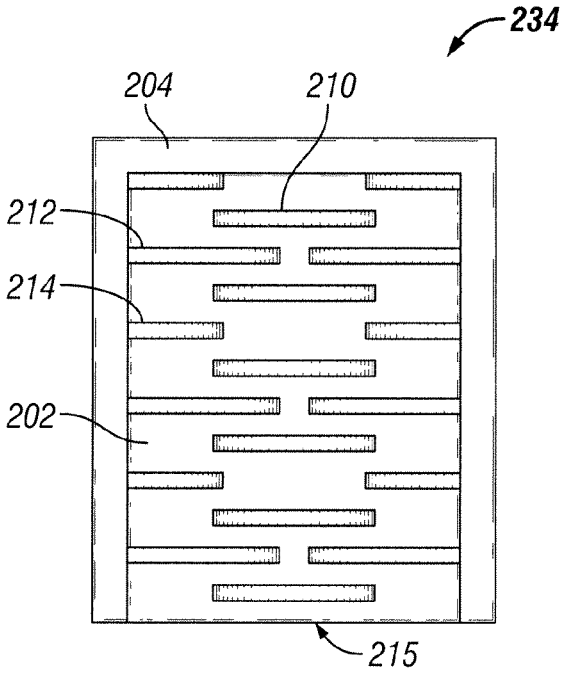
Figure 2C:
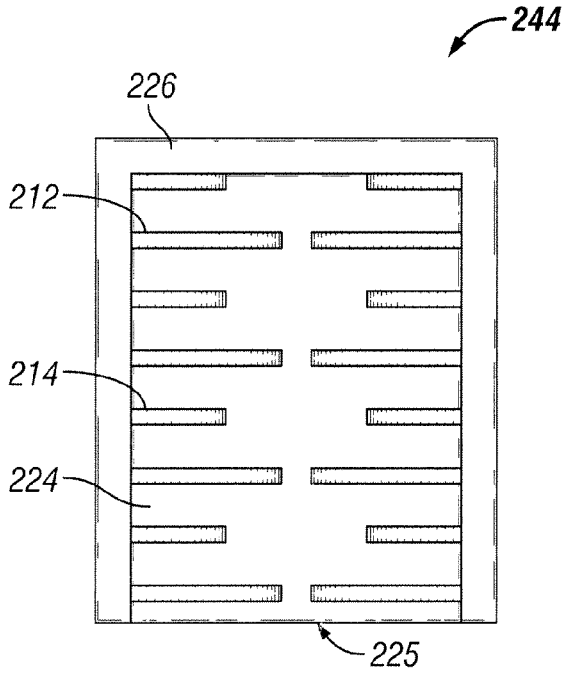

FIGS. 2A through 2C show various views of a number of various retractable members of a stationary portion for a quick lock conductor receiver in accordance with certain exemplary embodiments. In one or more embodiments, one or more of the components shown in FIGS. 2A through 2C may be omitted, repeated, and/or substituted. Accordingly, embodiments of enclosure quick lock conductor receivers should not be considered limited to the specific arrangements of components shown in FIGS. 2A through 2C.

Referring now to FIGS. 1-2C, FIGS. 2A and 2B show an exemplary stationary portion 234 with of a number of different retractable members 210, 212, 214, a bottom surface 202, and a number of walls 204 that extend orthogonally upward from an edge of the bottom surface 202 in accordance with certain exemplary embodiments. In this example, the stationary portion 234 includes a number of rows of conductive, retractable members 210, 212, 214 in the form of spring clips. The retractable members 210, 212, 214 form a matrix of spring clips. In certain exemplary embodiments, the retractable members 210, 212, 214 are made of at least one conductive material, while at least a portion of the rest of the stationary portion 234 (e.g., the bottom surface 202, the walls 204) are made of at least one non-conductive material. The rows formed by the retractable members 210, 212, 214 are positioned width-wise (parallel to the open end 215 of the stationary portion 234) and parallel to each other in the channel (i.e., between the walls 204) formed by the stationary portion 234. The retractable members 210, 212, 214 may be positioned in any other orientation (e.g., length-wise, diagonal, random) within the channel formed by the stationary portion 234 and/or with respect to each other.

The retractable member 210 in the front row (counting from the open end 215 of the channel formed by the stationary portion 234) is relatively short compared to the other retractable members 212, 214 in the stationary portion 234 of FIGS. 2A and 2B. There is a single retractable member 210 in the front row, but there can be two or more retractable members of varying shapes and/or sizes in any row. The retractable member 210, as well as other retractable members in subsequent rows, secure and provide electrical connectivity with a portion (e.g., the bottom, the sides) of the conductor when the conductor is positioned within the channel formed by the stationary portion 234. In this case, the retractable member 210 has a normal position when a conductor is not disposed within (is disengaged from) the channel formed by the stationary portion 134. When the conductor is disposed within (is engaged with) the channel formed by the stationary portion 234, the retractable member 210 is in a retracted position. In other words, the retractable member 210 is forced downward, toward the bottom surface 202 of the stationary portion 234. When the retractable member 210 (or any other retractable member in this example) is retracted, a compressive force (e.g., a compression spring of the spring clip) pushes against the conductor engaged in the channel in an attempt to return the retractable member 210 to the normal position. In this way, with retractable members on either side and on the bottom of the conductor, the conductor is secured by the retractable members.

In the second row, the retractable members 212 are shown in FIGS. 2A and 2B as symmetrically placed along the width of the channel formed by the stationary portion 234, creating an offset effect. Compared to the retractable member 210, the retractable members 212 are taller and have approximately the same width. The retractable members 212 also have approximately the same thickness as the retractable member 210. In this case, the retractable members 212 have a normal position when the conductor is not disposed within (disengaged from) the channel formed by the stationary portion 234. When the conductor is disposed within (engaged with) the channel formed by the stationary portion 234, the retractable members 212 are in a retracted position. In other words, the retractable members 212 are forced downward and/or sideways. In such a case, the retractable members 212 are in compression and push against the conductor engaged in the channel. The third row is shown in FIGS. 2A and 2B has the retractable member 210, substantially similar to the retractable member 210 in the first row.

In the fourth row, the retractable members 214 are shown as symmetrically placed along the width of the channel formed by the stationary portion 234. Compared to the retractable members 210, the retractable members 214 are taller and have a shorter width. Compared to the retractable members 212, the retractable members 214 are substantially the same height, but have a shorter width. The retractable members 212 also have approximately the same thickness as the retractable members 210 and the retractable members 212. In this case, the retractable members 214 have a normal position when the conductor is not disposed within (disengaged from) the channel formed by the stationary portion 234. When the conductor is disposed within (engaged with) the channel formed by the stationary portion 234, the retractable members 214 are in a retracted position. In other words, the retractable members 214 are forced downward and/or sideways. In such a case, the retractable members 214 are in compression and push against the conductor engaged in the channel.

Since the retractable members 214 do not extend into the center of the channel formed by the stationary portion 234 as much as the retractable members 212, the retractable members 214 may make minimal or no contact with smaller conductors positioned in the channel formed by the stationary portion 234. However, because smaller conductors carry less voltage and/or current, minimal or no contact by the retractable members 214 is not important in maintaining electrical connectivity between the conductor and the corresponding terminal of the fuse clip 100.

From there, the matrix pattern of spring clips repeats, with the retractable member 210 in every other row (each odd numbered row), and the retractable members 212 and the retractable members 214 alternate for the even rows. When the conductor is engaged with the retractable members 210, 212, 214 as shown in FIGS. 2A and 2B, the conductor is positioned antiparallel to the retractable members 210, 212, 214. Specifically, the conductor is positioned substantially perpendicular (i.e., normal) to the retractable members 210, 212, 214.

FIG. 2C shows a cross-sectional top view of a stationary portion 244 having a different matrix of retractable members compared to the matrix of retractable members shown in FIGS. 2A and 2B. Specifically, the retractable member 210 has been removed, so that each row alternates between the retractable members 212 and the retractable members 214. The retractable members 212 and the retractable members 214 of FIG. 2C may be spring clips, or may use some other form of retractable mechanism. At least a portion of the retractable members 212 and the retractable members 214 are mechanically coupled to the bottom 224 of the stationary portion 244.

Instead of spring clips, other members and/or elements may be used to operate the retractable function of the retractable members 212, 214. Examples of such other members can include, but are not limited to, springs (positioned along the length and/or along the width of the channel formed by the stationary portion 244), clips, malleable metal, and V-shaped protrusions. In any case, such members and/or elements may be made of at least one conductive material.

Figure 3C:
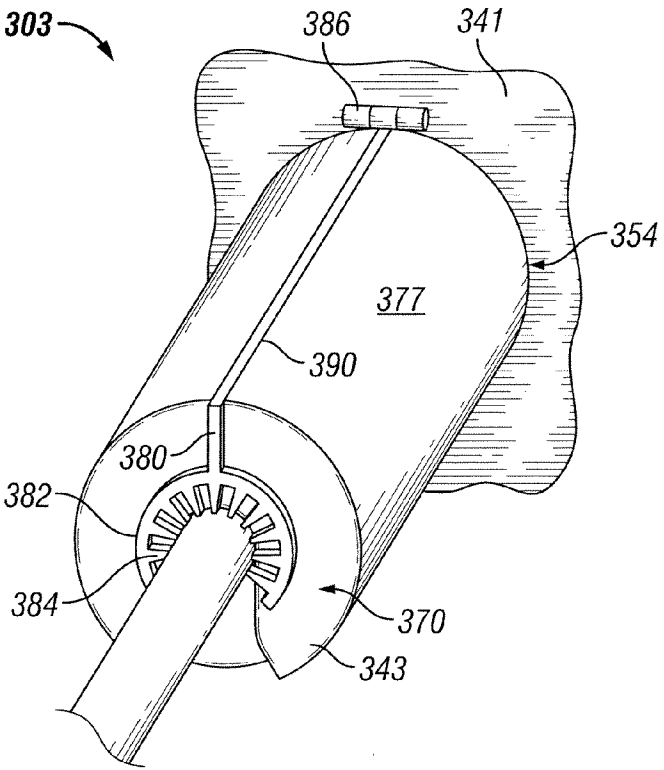
FIGS. 3A-3C show various views of a number of various mechanisms for aligning and/or securing a quick lock conductor receiver in accordance with certain exemplary embodiments.
Figure 3A:
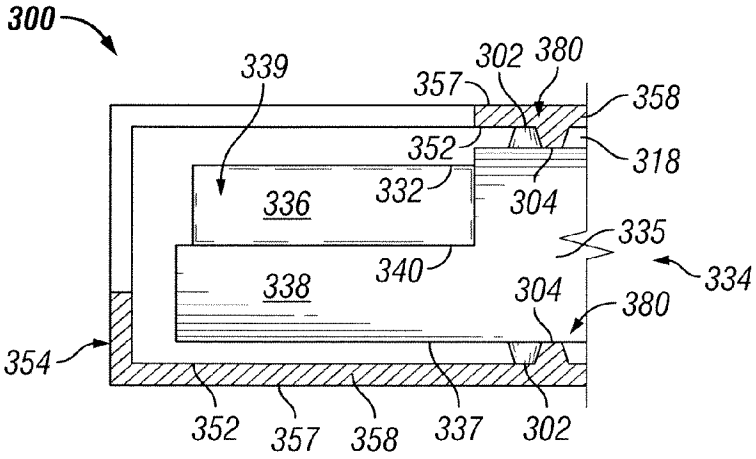
Figure 3B:
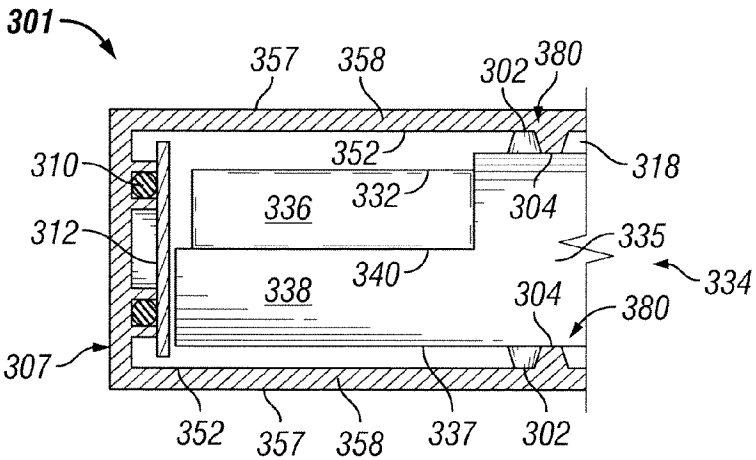

FIGS. 3A-3C show various views of locking and coupling mechanisms for exemplary conductor receivers. Referring to FIGS. 1A-3C, FIG. 3A shows a cross-sectional side view of a conductor receiver 300. The stationary portion 334 includes an electrically conductive retractable member 336 of an electrically conductive section 339 and an electrically non-conductive section 338. The electrically non-conductive section 338 also includes a collar 335.

The coupling mechanism 380 includes a pair of protruding members 302, 304. In this case, one of the protruding members 302 is disposed on the collar 335 of the stationary portion 334. The collar 335 is located at the proximal end (i.e., the end that mechanically and electrically couples to the fuse block) of the stationary portion 334. Further, the collar 335 is located adjacent to the retractable member 336. The other protruding member 304 is disposed on the inner surface 352 at the proximal end of the movable portion 354.

Each protruding member 302, 304 of the coupling mechanism 380 can be a separate member that is mechanically coupled (e.g., welded, epoxied, fastened) to the collar 335 of the stationary portion 334. In addition, or in the alternative, a protruding member 302, 304 of the coupling mechanism 380 can also be a feature formed on the collar 335 of the stationary portion 334 and/or on the inner surface 352 of the movable portion 354, respectively. The protruding member 302 can be disposed on all or one or more portions of the outer surface of the collar 335 of the stationary portion 334. Similarly, the protruding member 304 can be disposed on all or one or more portions of the inner surface 352 of the movable portion 354.

The coupling mechanism 302, 304 can be made of the same or different material from the material of the stationary portion 334 and/or the movable portion 354. The coupling mechanism 380 can avoid wear, deformation, degradation, and/or any other condition that alters the shape of the coupling mechanism 380. The protruding members 302, 304 can be mechanically coupled to each other using one or more of a number of configurations, including but not limited to mating threads, a compression fitting, and a bump and channel fitting.

In certain exemplary embodiments, a stop feature 318 is coupled to the collar 335 of the stationary portion 334 and/or the inner surface 352 of the movable portion 354. The stop feature 318 prevents the movable portion 354 from rotating beyond a certain point relative to the stationary portion 334. Specifically, the stop feature 318 can be positioned to contact a feature (e.g., a protruding member 302, 302, another stop feature 318) to prevent the movable portion 354 from rotating beyond a certain point relative to the stationary portion 334.

The stop feature 318 can be a separate member that is mechanically coupled (e.g., welded, epoxied, fastened) to the collar 335 of the stationary portion 334 and/or the inner surface 352 of the movable portion 354. In addition, or in the alternative, the stop feature 318 can be a feature formed on the collar 335 of the stationary portion 334 and/or on the inner surface 352 of the movable portion 354. There may be more than on stop feature 318 disposed on the outer surface of the collar 335 of the stationary portion 334 and/or the inner surface 352 of the movable portion 354.

The conductor receiver 301 of FIG. 3B shows, in addition to the coupling mechanism 380 and stop feature 318, an exemplary locking mechanism 307 that is used to secure the conductor in place within the conductor receiver 301. In this example, the locking mechanism 307 includes a gasket 310 (e.g., an o-ring) through which the conductor is fed. The gasket 310 can be a discrete segment or a closed loop. The gasket 310 can be made of one or more of a number of compressible materials, including but not limited to rubber and neoprene. The gasket 310 can be made of electrically and/or thermally conductive or non-conductive material. The gasket 310 can be disposed within a channel formed at the distal end of the stationary portion 334 and/or the distal end of the movable portion 354.

In certain exemplary embodiments, the locking mechanism 307 can also include a plate 312 positioned adjacent to the gasket 310 and through which the conductor also passes. Specifically, the plate 312 can be positioned between the distal end of the stationary portion 334 and the gasket 310. The plate 312 can be a separate piece, part of the stationary portion 334, and/or part of the movable portion 354. The plate 312 can be of any shape as to contact all or a portion of the gasket 310 when a force is applied to the plate 312. For example, as the movable portion 354 rotates to the closed position and contacts the stop feature 318, the distance between the distal end of the movable portion 354 and the distal end of the stationary portion 334 decreases. As a result, a force is applied to the gasket 310 by the plate 310, causing the gasket 310 to expand. As the gasket 310 expands, the gasket 310 contacts and secures the conductor. When the movable portion 354 is locked into the closed position, the conductor is secured in place by the gasket 310. When the movable portion 354 is in the open position, the gasket 310 no longer secures the conductor.

Another exemplary locking mechanism 390 is shown for the conductor receiver 303 in FIG. 3C. In this case, the locking mechanism 390 is positioned external to the conductor receiver 303. The locking mechanism 390 of FIG. 3C includes a main member 380. In this case, the main member 380 is a L-shaped device with one or more linking arms 386 at the proximal end and a conductor receiver 382 at the distal end. The conductor receiver 382 can include a number of inwardly-extending fingers 384 that allow the conductor to pass in the direction toward the linking arms 386, but do not allow the conductor to pass in the direction away from the linking arms 386.

The locking mechanism 390 and its components can be made of electrically and/or thermally conductive or non-conductive material. The locking mechanism 390 can be made of a non-compressive material. In addition to preventing the conductor from being moved away from the linking arms 386, the locking mechanism 390 can be used to keep the movable portion 354 in the closed position relative to the stationary portion 334. For example, the linking arms 386 can be secured to one or more receiving elements in the collar 341 of the stationary portion 334 and/or in the device. Alternatively, or in addition, the main member 380 can fit into a slot in the front face 343 of the stationary portion 334 and/or a slot along the top of the outer surface 377 of the movable portion 354 when the movable portion 354 is in the closed position. In this example, both the slot in the front face 343 of the stationary portion 334 and the slot along the top of the outer surface 377 of the movable portion 354 are hidden from view by the main member 380 positioned in such slots.

Figure 4A:
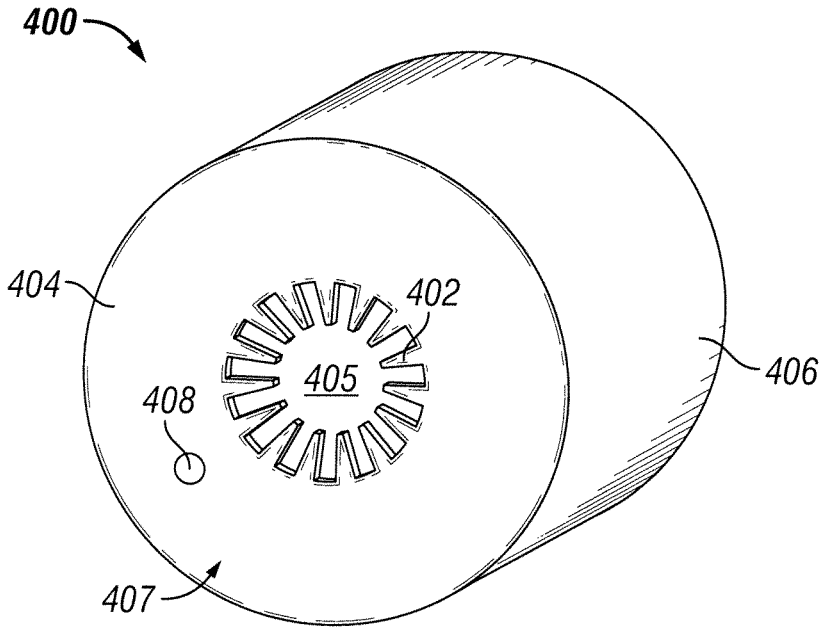
FIGS. 4A and 4B show perspective views of an exemplary system for securing a conductor in a quick lock conductor receiver in accordance with certain exemplary embodiments.
Figure 4B:
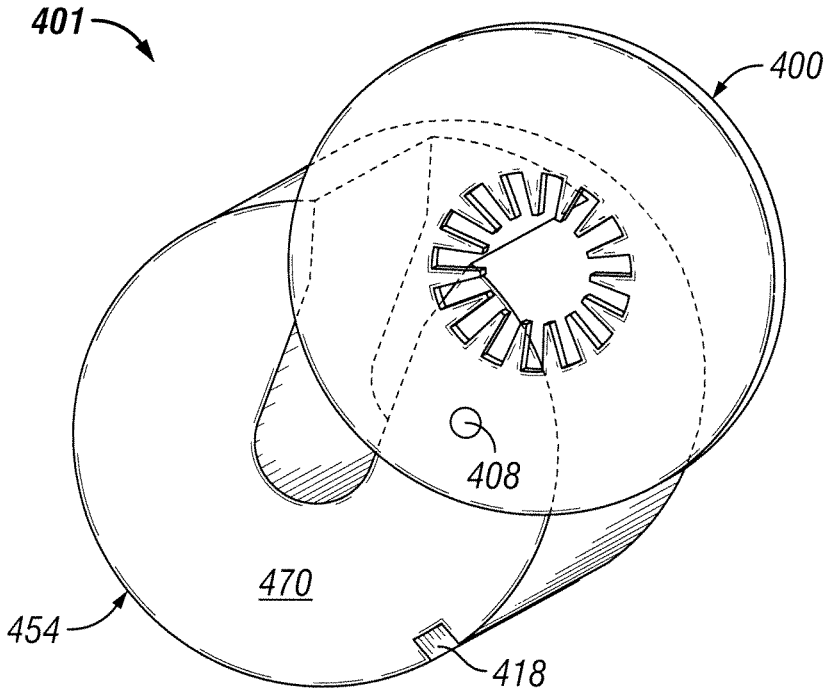

FIGS. 4A and 4B show an alternative locking mechanism 400 that is used to secure a conductor and/or to keep the movable portion 454 in the closed position relative to the stationary portion. Specifically, FIG. 4A shows a locking mechanism 400 that includes a body 406 having a cylindrical shape with two ends 407, where each end 407 has a face 404. An aperture 405 traverses the body 406 between the ends 407. The perimeter of the aperture 405, for at least one end 407, includes a number of inwardly-extending fingers 402. The inwardly-extending fingers 402 allow the conductor to pass through the aperture 405 in one direction, but not in the opposite direction.

The locking mechanism 400 of FIG. 4A can be a separate piece, integrated with the stationary portion, and/or integrated with the movable portion 454. The locking mechanism 400 can also include one or more aligning mechanisms 408. The aligning mechanism 408 can be a protrusion and/or an aperture. In this case, the aligning mechanism 408 is an aperture in one end 407 between the aperture 405 and the outer edge of the end 407. The aligning mechanism 408 can mate with a corresponding feature of the movable portion 454 and/or the stationary portion. In such a case, the locking mechanism 400 can be fixedly coupled to the movable portion 454 and/or the stationary portion. In such a case, as the movable portion 454 is rotated into the closed position, a compressive force may be applied to all or a portion of the locking mechanism 400, causing the inwardly-extending fingers 402 to more firmly secure the conductor. In addition, strain relief can rotate the conductor into the opening of the stationary portion and/or the movable portion 454

Further, as shown in FIG. 4B, a stop feature 418 is disposed on the collar front face 470 of the movable portion 454. The stop feature 418 prevents the movable portion 454 from rotating beyond a certain point relative to the stationary portion. In certain exemplary embodiments, the aligning mechanism 408 of the locking mechanism 400 can be used with the stop feature 418 to prevent the movable portion 454 from rotating beyond a certain point relative to the stationary portion.

FIGS. 5A through 5E show an example of securing a conductor 510 using an exemplary quick lock conductor receiver 500 in accordance with certain exemplary embodiments. Referring to FIGS. 1-5E, the cross-sectional end view of the quick lock conductor receiver 500, shown in FIG. 5A, includes a movable portion 532 that rotates axially around a stationary portion 530. The stationary portion 530 includes retractable members 536 in the form of vertical side walls. The stationary portion 530 also includes a retractable member 537 disposed on the bottom of the stationary portion 530. The volume between the retractable members 536 and the retractable member 537 is the channel within the stationary portion 530. The movable portion 532 includes a retractable member 538 made of conductive material and is shown in the open position in FIG. 5A. The opening 531 of the movable portion 532 is substantially aligned with the opening 551 formed by the stationary portion 530. In this example, the opening 531 and the retractable member 538 are on substantially opposite sides of the movable portion 532.

FIG. 5B shows a conductor 510 that is beginning to be inserted into the opening 551 of the stationary portion 530. Specifically, the conductor 510 is beginning to engage the top portions of the retractable members 536. The conductor 510 passes through the opening 531 of the movable portion 532 to reach the opening 551 of the stationary portion 530. The diameter of the conductor 510 is larger than the width 560 within the channel between the retractable members 536. In FIG. 5B, the conductor 510 begins to engage the retractable members 536. Because of the size of the conductor 510 relative to the width between the retractable members 536 when the retractable members 536 are in the normal position, the retractable members 536 begin to retract when engaged by the conductor 510. The movable portion 532 remains in the open position.

In certain exemplary embodiments, the conductor 510 is made from one or more of a number of conductive materials (e.g., copper, aluminum). The conductive material of the conductor 510 can be the same as or different than the material of the retractable members 536, 537, 538. The cross-sectional profile of the conductor 510 can have one or more of a number of shapes (e.g., circular, oval, square). The conductor 510 may be surrounded by an insulating layer made from one or more of a number of non-conductive materials (e.g., rubber, plastic). In certain exemplary embodiments described herein, a portion of any such insulating layer that surrounds the conductor 510 is stripped away so that the conductive material of the conductor 510 is exposed where the conductor 510 is inserted into the receiving portion 530. The conductor 510 may be a single wire, a single-conductor cable, part of a multi-conductor cable, or any other suitable form of conductor that can be secured in the conductor receiver 500.

FIG. 5C shows the conductor 510 fully inserted into (engaged by) the stationary portion 530 of the conductor receiver 500. In this case, the retractable members 536 are compressed and, due to the compressive force of the retractable material of the retractable members 536, apply pressure against the side walls of the conductor 510, resulting in solid electrical connectivity between the conductor 510 and the corresponding terminal (e.g., fuse block, motor, relay, contactor, terminal block) of the device to which the conductor receiver 500 is connected. In addition, the retractable member 537 disposed on the bottom of the stationary portion 530 is put in the retracted position when the conductor 510 is fully engaged. As a result, further solid electrical connectivity is made between the conductor 510 and the corresponding terminal of the device to which the conductor receiver 500 is connected. The movable portion 532 remains in the open position.

FIG. 5D shows the movable portion 532 moving from the open position toward the closed position. The conductor 510 remains secured within the stationary portion 530. As the movable portion 532 rotates, so does the retractable member 538 and the opening 531. FIG. 5E shows the movable portion 532 in the closed position, which in this example is when the movable portion 532 has rotated approximately 180°. In the closed position, the retractable member 538 of the movable portion 532 contacts and secures the top portion of the conductor 510. When the movable portion 532 is in the closed position, the opening 531 is located on the opposite end from where the channel formed by the stationary portion 530 is directed. A locking mechanism (not shown) may be used to secure the movable portion 532 in the closed position. To disengage the conductor 510 from the conductor receiver 500, the process described above with respect to FIGS. 5A-5E is reversed.

Figure 6:
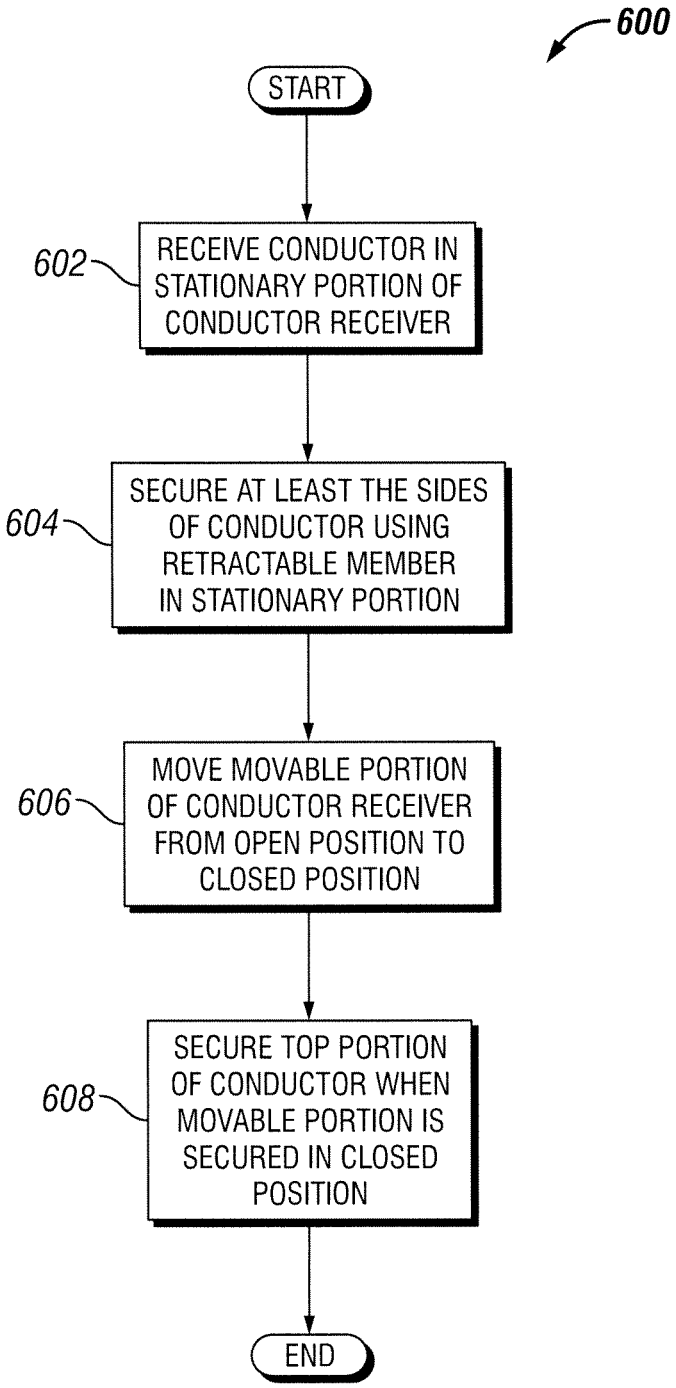
FIG. 6 shows a flowchart of a method of securing a conductor using a quick lock conductor receiver in accordance with certain exemplary embodiments.

FIG. 6 shows a flowchart of a method for engaging a conductor in accordance with certain exemplary embodiments. While the various steps in this flowchart are presented and described sequentially, one of ordinary skill will appreciate that some or all of the steps may be executed in different orders, may be combined or omitted, and some or all of the steps may be executed in parallel. Further, in certain exemplary embodiments, one or more of the steps described below may be omitted, repeated, and/or performed in a different order. In addition, a person of ordinary skill in the art will appreciate that additional steps, omitted in FIG. 6, may be included in performing this method. Accordingly, the specific arrangement of steps shown in FIG. 6 should not be construed as limiting the scope.

Referring now to FIGS. 1-6, the exemplary method begins at the START step and continues to step 602. In step 602, a conductor 510 is received in the stationary portion 530 of a conductor receiver 500. The conductor 510 may be inserted into the stationary portion 530 by a user. The user may insert the conductor 510 into the stationary portion 530 my hand, either using one or more tools (e.g., pliers) or without the use of tools. As the conductor 510 is received by the stationary portion 530 of the conductor receiver 500, the retractable members 210, 212, 214 may offer resistance. Extra force may be applied to the conductor 510 to cause the conductor 510 to be fully received by the retractable members 210, 212, 214, 536, 537 of the stationary portion 530. The larger the conductor 510 (i.e., the heavier the wire gauge of the conductor 510), the more resistance that the retractable members 210, 212, 214, 536, 537 present. During this step 402, the movable portion 532 of the conductor receiver 500 is in an open position to allow the conductor 510 to pass therethrough and be received by the stationary portion 530.

In step 604, at least the sides of the conductor 510 are secured using one or more retractable members 212, 214, 536 in the stationary portion 530. The extent to which the conductor 510 is secured can vary based on one or more of a number of factors, including but not limited to the thickness of the conductor 510 relative to the width and/or depth of the channel formed by the stationary portion 530, the shape of the conductor 510, and the shape of the retractable members 212, 214, 536. In certain exemplary embodiments, the bottom of the conductor 510 is also secured using one or more retractable members 210, 537 along the bottom of the stationary portion 530.

In step 606, the movable portion 532 of the conductor receiver 500 is moved from the open position to the closed position. The movable portion 532 may be moved to the closed position by the user. The user may move the movable portion 532 into the closed position my hand, either using one or more tools (e.g., pliers) or without the use of tools. The movable portion 532 may be moved from the open position to the closed position in one or more of a number of ways, depending on how the movable portion 532 and the stationary portion 530 are coupled. For example, if the movable portion 532 is hingedly coupled to an end of the stationary portion 530, the movable portion 532 may be moved to the closed potion by moving the movable portion 532, using the hinge, toward the stationary portion 530. As another example, if the movable portion 532 is axially coupled to the stationary portion 530, then the movable portion 532 can be moved from the open position to the closed position by axially rotating the movable portion 532.

In step 608, the top portion of the conductor 510 is secured. The top portion of the conductor 510 can be secured by the movable portion 532 and/or one of its components. Specifically, the top portion of the conductor 510 can be secured when the movable portion 532 approaches and/or is at the closed position. In certain exemplary embodiments, the top portion of the conductor 510 is secured, at least in part, by the retractable member 538 of the movable portion 532, which moves toward and contacts the top portion of the conductor 510 as the movable portion 532 approaches and/or is at the closed position. The top portion of the conductor 510 may also be secured, at least in part, when the movable portion 532 is locked (e.g., fastened, secured) into the closed position. In such a case, additional force may be applied between the movable portion 532, locked in the closed position, and the top portion of the conductor 510.

To remove the conductor 510 from the conductor receiver 500, the process may be reversed. In this case, for example, the movable portion 532 may be unlocked from the closed position, the movable portion 532 may be moved from the closed position to the open position, and the conductor 510 may be removed from the stationary portion 530. Removing the conductor may be performed with and/or without the use of tools by a user.

Exemplary embodiments provide for an improved conductor receiver. Specifically, certain exemplary embodiments allow a user to apply a wire to a conductor receiver without the use of (or with limited use of) tools. Further, exemplary embodiments provide a user with a visual indication that a conductor is securely received into the conductor receiver. Certain exemplary embodiments also provide for visual confirmation that the conductor receiver is securely locked into a closed position. Exemplary embodiments may be used with a number of sizes and/or shapes of conductor.

In addition, exemplary embodiments have no spring connections or other similar components that require periodic maintenance and/or servicing. Exemplary conductor receivers described herein may be positioned in a number of different locations on an electrical device (e.g., fuse block, contactor). As such, the placement of exemplary conductor receivers on an electrical device can provide one or more of a number of electrical and/or mechanical benefits relative to the conductor. Such benefits can include, but are not limited to, strain relief, ease of installation, ease of maintenance, reduced occurrence of an over-temperature situation, reduced occurrence of an over-current situation, reduced occurrence of a ground fault situation and/or other short circuit situations, and visual confirmation of connectivity to the conductor receiver.

Although embodiments described herein are made with reference to exemplary embodiments, it should be appreciated by those skilled in the art that various modifications are well within the scope and spirit of this disclosure. Those skilled in the art will appreciate that the exemplary embodiments described herein are not limited to any specifically discussed application and that the embodiments described herein are illustrative and not restrictive. From the description of the exemplary embodiments, equivalents of the elements shown therein will suggest themselves to those skilled in the art, and ways of constructing other embodiments using the present disclosure will suggest themselves to practitioners of the art. Therefore, the scope of the exemplary embodiments is not limited herein.

What is claimed is:

1. A conductor receiver, comprising:

a stationary portion comprising:

at least one first surface;

at least one first conductive retractable member disposed on the at least one first surface; and a channel formed by the at least one first surface and the at least one first conductive retractable member, wherein the channel has a first width that is less than a second width of a conductor, wherein the at least one first conductive retractable member retracts when the conductor engages the channel so that the first width is substantially the same as the second width; and a movable portion having a closed position and an open position and moveably coupled to the stationary portion, wherein the movable portion comprises at least one second surface, wherein the at least one second surface secures a top portion of the conductor when the conductor is engaged in the channel and when the movable portion is in the closed position.

2. The conductor receiver of claim 1, further comprising:

a locking mechanism that mechanically secures the movable portion to the stationary portion when the movable portion is in the closed position.

3. The conductor receiver of claim 1, wherein the movable portion is rotatably coupled to the stationary portion.

4. The conductor receiver of claim 1, wherein the movable portion is hingedly coupled to the stationary portion.

5. The conductor receiver of claim 1, wherein the movable portion further comprises a second conductive retractable member disposed on at least a portion of the at least one second surface, wherein the second conductive retractable member retracts when the movable portion is in the closed position and when the conductor is engaged in the channel.

6. The conductor receiver of claim 1, wherein the at least one first conductive retractable member of the stationary portion is disposed on the at least one first surface in a plurality of adjacent rows, wherein each row of the plurality of rows is positioned within a third width of the stationary portion.

7. The conductor receiver of claim 1, wherein the movable portion and the stationary portion are part of an electrical device, where the movable portion and the stationary portion are positioned on an upper portion of the electrical device to provide strain relief to the conductor when the conductor is engaged with the stationary portion.

8. The conductor receiver of claim 1, wherein the conductor comprises a size of a range of sizes.

9. A conductor receiver, comprising:

a channel comprising a plurality of rows for receiving a conductor having a first width, wherein the channel comprises a second width and an open end along the second width, wherein the second width is greater than the first width;

a first row of the plurality of rows positioned within the second width of the channel and comprising at least one first retractable conductive member comprising a third width that is less than the first width;

a second row of the plurality of rows positioned within the second width of the channel adjacent to the first row, wherein the second row comprises at least one second retractable conductive member comprising a fourth width, wherein the fourth width is less than the first width, wherein the at least one first conductive retractable member and the at least one second retractable conductive member retract when the conductor engages the channel so that the third width and the fourth width are substantially the same as the first width.

10. The conductor receiver of claim 9, wherein the third width and the fourth width are different widths.

11. The conductor receiver of claim 9, wherein the at least one first retractable conductive member is offset, when viewing the channel from the open end, from the at least one second retractable conductive member.

12. The conductor receiver of claim 9, wherein the first row and the second row are substantially parallel to the open end of the channel.

13. The conductor receiver of claim 9, wherein the conductor, when engaged with the at least one first retractable conductive member and the at least one second retractable conductive member, is antiparallel to the first row and the second row.

14. The conductor receiver of claim 9, wherein the first row is substantially parallel to the second row.

15. The conductor receiver of claim 9, further comprising:

a movable portion hingedly coupled to the stationary portion and having an open position and a closed position, wherein the movable portion, in the open position, avoids contact with a top portion of the conductor, and wherein the movable portion, in the closed position, contacts the top portion of the conductor.

16. The conductor receiver of claim 9, wherein the conductor comprises one of a plurality of sizes.

* * * * *